US005784950A

United States Patent [19]

Kayukawa et al.

[11] Patent Number: 5,784,950

[45] Date of Patent: Jul. 28, 1998

[54] SINGLE HEADED SWASH PLATE TYPE COMPRESSOR HAVING A PISTON WITH AN OIL COMMUNICATION HOLE ON A SIDE OF THE PISTON REMOTE FROM THE CYLINDER BORE AND CRANK CHAMBER

[75] Inventors: Hiroaki Kayukawa; Suguru Hirota; Hideki Mizutani; Fuminobu Enokijima; Takehito Tomita; Yoshitami Kondo; Takahiro Hamaoka; Kenji Takenaka, all of Kariya, Japan

[73] Assignee: Kabushiki Kaisha Toyoda Jidoshokki Seisakusho, Kariya, Japan

[21] Appl. No.: 824,368

[22] Filed: Mar. 25, 1997

[30] Foreign Application Priority Data

Mar. 26, 1996 [JP] Japan ..... 8-070448

[51] Int. Cl.[6] ..... F01B 3/00

[52] U.S. Cl. ..... 92/71; 92/154; 184/6.17; 417/269

[58] Field of Search ..... 184/6.17; 92/12.2, 92/71, 153, 154; 417/269

[56] References Cited

U.S. PATENT DOCUMENTS

| | | | |
|---|---|---|---|
| 1,714,145 | 5/1929 | Sperry | 417/269 |
| 2,250,607 | 7/1941 | Sherman | 417/269 |
| 4,522,112 | 6/1985 | Nomura | 92/71 |
| 5,011,377 | 4/1991 | Sagawa | 417/269 |
| 5,495,789 | 3/1996 | Ogura et al. | 92/154 |
| 5,630,353 | 5/1997 | Mittlefehidt et al. | 92/71 |

FOREIGN PATENT DOCUMENTS

| | | |
|---|---|---|
| 50-120005 | 10/1975 | Japan . |
| 54-96403 | 7/1979 | Japan . |
| 58-10172 | 1/1983 | Japan . |
| 60-175783 | 9/1985 | Japan . |
| 61-88075 | 6/1986 | Japan . |
| 61-135990 | 6/1986 | Japan . |
| 61-192581 | 11/1986 | Japan . |
| 62-108576 | 7/1987 | Japan . |
| 1-71178 | 5/1989 | Japan . |
| 1-130074 | 5/1989 | Japan . |
| 2-54387 | 4/1990 | Japan . |
| 3-11165 | 1/1991 | Japan . |
| 4-330385 | 11/1992 | Japan . |
| 4-134977 | 12/1992 | Japan . |
| 5-71528 | 3/1993 | Japan . |
| 5-99135 | 4/1993 | Japan . |
| 6-47678 | 6/1994 | Japan . |

*Primary Examiner*—Thomas E. Denion
*Attorney, Agent, or Firm*—Burgess, Ryan & Wayne

[57] ABSTRACT

A single headed swash plate type compressor including, a housing with a crank chamber and cylinder bore, pistons arranged in cylinder bores, and a swash plate driven by a drive shaft. Each of the pistons has at one end thereof a bearing having axially spaced first and second bearing portions and an axially extending third portion interconnecting the first and second bearing portions. Shoes are slidably arranged between the swash plate and the first and second bearing portions for converting rotational movement of the swash plate into reciprocal movement of the pistons. An oil communication hole is arranged in and extends through the second bearing portion for fluid communication between the groove of the second bearing portion on the side remote from the cylinder bore and the crank chamber.

10 Claims, 3 Drawing Sheets

SINGLE HEADED SWASH PLATE TYPE COMPRESSOR HAVING A PISTON WITH AN OIL COMMUNICATION HOLE ON A SIDE OF THE PISTON REMOTE FROM THE CYLINDER BORE AND CRANK CHAMBER

BACKGROUND OF THE INVENTION

1. Field of the Invention

The present invention relates to a single headed swash plate type compressor used for compressing cooling gas in, for example, an automotive air conditioning system. In particular, the present invention relates to lubrication for shoes arranged in the compressor between a swash plate and pistons.

2. Description of the Related Art

A single headed swash plate type compressor, known from Japanese Unexamined Patent Publication (Kokai) No. 60-175783, for example, includes a housing with a crank chamber and parallel cylinder bores formed therein, pistons reciprocatingly arranged in the respective cylinder bores for compressing cooling gas in the cylinder bores, a swash plate attached to the drive shaft in the crank chamber, and semi-spherical shoes slidably arranged between the swash plate and the pistons for converting the rotational movement of the swash plate into the reciprocal movement of the pistons. In this compressor, each of the pistons has a piston rod having a bearing having axially spaced first and second bearing portions and an axially extending third portion interconnecting the first and second bearing portions, with the first bearing portion arranged on the side near the cylinder bore, the second bearing portion on the side remote from the cylinder bore. The first and second bearing portions have mutually facing surfaces with semi-spherical grooves formed therein, and semi-spherical surfaces of the semi-spherical shoes are received in the semi-spherical grooves.

In this type compressor, when the automobile is left unused for a long time, cooling gas in the crank chamber of the compressor may condense into a liquid phase or vaporize into a gaseous phase, due to a difference in the temperature in the condenser, the evaporator and the compressor of the refrigerating circuit. If such condition are repeated, lubricating oil contained in cooling gas in the crank chamber of the compressor may be conveyed out of the compressor and the sliding surfaces between the semi-spherical shoes and the swash plate and between the semi-spherical shoes and the first and second bearing portions become dry. This phenomena has particularly appeared recently, namely, since a Freon substitute has been used as cooling gas. This problem had not often appeared previously, and it is said that this is because chlorine contained in cooling gas has a function corresponding to solid lubricants.

When the compressor is started in the condition in which lubricating oil contained in the crank chamber is conveyed out of the compressor and the sliding surfaces become dry (poor lubricating condition), the swash plate can be lubricated since lubricating oil reserved in the bottom region of the crank chamber can be carried by the periphery of the swash plate during its rotation, although the amount of liquid lubricating oil reserved in the crank chamber may be small. That is, when the swash plate is rotated one revolution, lubricating oil is extended all around the entire periphery of the swash plate. Therefore, lubricating oil can soak in the sliding surfaces between the swash plate and the semi-spherical shoes, so regarding these sliding surfaces, the poor lubricating condition is overcome within a short time.

However, lubricating oil can soak only slightly into the sliding surfaces between the semi-spherical shoes and the first and second bearing portions, when the compressor is started in the poor lubricating condition, since lubricating oil contacts only portions of the semi-spherical surfaces of the shoes that are revealed to the crank chamber and is then extended all around the sliding surfaces between the semi-spherical shoes and the first and second bearing portions during the rotation of the swash plate and the wobble motion of the shoes. Therefore, much time is necessary for the lubricating oil to be fully extended. In addition, a lubricating oil mist flowing in the crank chamber and contained in blow-by gas leaking through a clearance between the cylinder bores and the pistons is mainly supplied to the sliding surfaces between the semi-spherical shoes and the first and second bearing portions. Therefore, lubricating oil is insufficiently extended into the sliding surfaces between the semi-spherical shoes and the first and second bearing portions, compared to the sliding surfaces between the swash plate and the semi-spherical shoes.

In particular, blow-by gas can easily flow to the semi-spherical shoes located on the side near the cylinder bore, but the blow-by gas cannot easily flow to the semi-spherical shoes located on the side remote from the cylinder bores since the swash plate prevents such a flow of blow-by gas. Therefore, the sliding surfaces between the semi-spherical shoes and the second bearing portions located on the side remote from the cylinder bores are less lubricated, compared to the sliding surfaces between the semi-sphericai shoes and the first bearing portions located on the side near the cylinder bore. Therefore, galling, burning or locking may tend to occur in the sliding surfaces between the semi-spherical shoes and the second bearing portions located the side remote from the cylinder bores.

SUMMARY OF THE INVENTION

The object of the present invention is to solve the above described problems and to provide a compressor in which lubricating oil can be supplied to sliding surfaces between semi-spherical shoes and bearing portions located on the side remote from cylinder bores at positions where lubrication is difficult when the compressor is started in a poorly lubricated condition.

According to the present invention, there is provided a single headed swash plate type compressor comprising: a housing having a crank chamber and parallel cylinder bores formed therein; pistons reciprocatingly arranged in the cylinder bores for compressing cooling gas in the cylinder bores, each of the pistons having at one end thereof axially spaced first and second bearing portions and an axially extending third portion interconnecting the first and second bearing portions, the first bearing portion being arranged on the side near the cylinder bore, the second bearing portion being arranged on the side remote from the cylinder bore, said first and second bearing portions having mutually facing surfaces with grooves formed therein; a drive shaft rotatably arranged in the housing; a swash plate attached to the drive shaft in the crank chamber; a shoe slidably arranged between the swash plate and each of the first and second bearing portions in the groove thereof for converting the rotational movement of the swash plate into the reciprocal movement of the pistons; and an oil communication hole extending through the second bearing portion for fluid communication between the groove of the second bearing portion and the crank chamber.

In this arrangement, the swash plate is rotated by the drive shaft, and the pistons are reciprocatingly moved via the shoes. Cooling gas is thus compressed in the cylinder bores by the pistons. When the compressor is started, blow-by gas leaks through a clearance between the cylinder bores and the pistons into the crank chamber. Misty lubricating oil contained in cooling gas is introduced to the sliding surfaces between the shoes and the grooves of the second bearing portion on the side remote from the cylinder bores, through the oil communication hole provided in the second bearing portion. Therefore, it is possible to efficiently lubricate the portion of the compressor at which it was difficult to sufficiently supply lubricating oil. A lubricating function is thus sufficiently ensured even when the compressor is started after the automobile is left unused for a long time.

Preferably, the compressor further comprises a through hole extending through the swash plate for fluid communication between a portion of the crank chamber on one side of the swash plate and another portion of the crank chamber on the other side of the swash plate.

In this arrangement, when the compressor is started, blow-by gas flows in a portion of the crank chamber on one side of the swash plate, and from that portion to another portion of the crank chamber on the other side of the swash plate through the through hole in the swash plate. Lubricating oil contained in blow-by gas is thus introduced to the sliding surfaces between the shoes and the grooves of the second bearing portion on the side remote from the cylinder bore, through the oil communication hole in the second bearing portion. Lubricating function is thus rapidly effected.

Preferably, the compressor further comprises a recess arranged in the groove of the first bearing portion at a position on an axis of said oil communication hole. The recess arranged in the groove of the first bearing portion functions as an oil reservoir, and it is possible to avoid that the compressor is in a poor lubricating condition while the compressor is stopped. The sliding surfaces between the shoes and the grooves of the first bearing portions can be lubricated by lubricating oil reserved in this recess when the compressor is started. This recess can be easily machined since it is arranged on the axis of the oil communication hole.

Preferably, said shoe is formed in a semi-spherical shape with a semi-spherical surface and a flat surface, and said groove is formed in a semi-spherical shape, the semi-spherical surface of the semi-spherical shoe slidably engaging in the semi-spherical groove and the flat surface of the semi-spherical shoe being slidable against the swash plate on the peripheral region thereof.

The semi-spherical shoes can slide in a three dimensional manner, accompanying their rotation in the semi-spherical grooves, so the stable sliding contacts can be ensured even if the tilting angle of the swash plate changes and reliability of the compressor is enhanced. Therefore, the sliding engagement between the swash plate and the pistons via the shoes becomes stable.

Preferably, the compressor further comprises a guide hole extending through the shoe between the flat surface thereof and the spherical surface thereof. In this arrangement, the peripheral region of the swash plate contacts lubricating oil reserved in the lower part of the crank chamber and lubricating oil is extended all around the entire periphery of the swash plate when the swash plate is rotated one revolution, and lubricating oil can soak in the sliding surfaces between flat portions of the semi-spherical shoes and the periphery of the swash plate, just after the compressor is started. In addition, lubricating oil is introduced to the sliding surfaces between semi-spherical surfaces of the semi-spherical shoes and the semi-spherical grooves of the first and second bearing portions, through the guide hole in the shoe.

Preferably, the guide hole has first, and second opposite ends, at least one of the first and second ends being enlarged, compared with the remaining portion of said guide hole. Preferably, the shoe has in the flat surface thereof radially extending grooves to merge the guide hole.

Preferably, cooling gas to be compressed comprises 1,1,1,2-tetrafluoroethane.

Preferably, the compressor further comprises a recess formed on the outer surface of the pistons, so that blow-by gas can smoothly flow from the cylinder bore to the crank chamber.

Preferably, the compressor further comprises a lag plate attached to the drive shaft in the crank chamber for rotation therewith, the lag plate having a pair of support arms extending toward the swash plate, the support arms having guide holes; and the swash plate having a pair of connecting members extending toward the lag plate, the connecting members being slidably and tiltably fitted in the guide holes of the support arms, so that the swash plate is hinged to the lag plate by the support arms and the connecting members to allow the tilting angle of the swash plate to be changed to control the capacity of said compressor.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
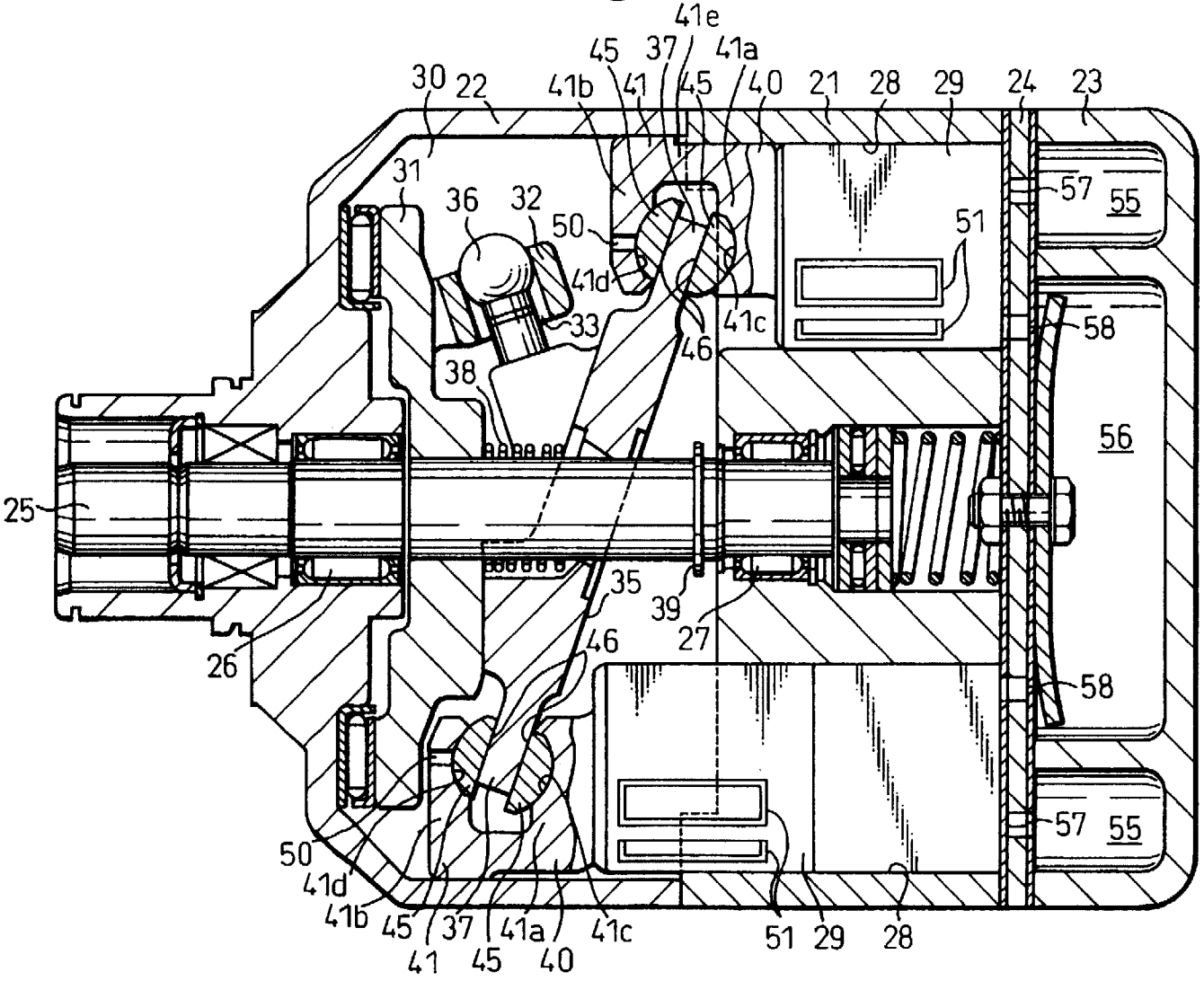
FIG. 1 is a cross-sectional view of the compressor according to the first embodiment of the present invention.

Referring to FIG. 1, the single headed swash plate type compressor comprises a housing including a cylinder block 21, a front housing 22 attached the front end of the cylinder block 21, and a rear housing 23 attached the rear end of the cylinder block 21 via a valve plate 24.

A drive shaft 25 extends axially centrally in the front housing 22 and the cylinder block 21 of the housing and is rotatably supported by a pair of radial bearings 26 and 27.

The cylinder block 21 has a plurality of cylinder bores 28 having respective axes arranged parallel to the axis of the drive shaft 25 on a common circle at a certain pitch and extending through the cylinder block 21 between the front and rear ends thereof. Single headed pistons 29 are reciprocatingly arranged in the respective cylinder bores 28 for compressing cooling gas in the cylinder bores 28.

A crank chamber 30 is formed in the front housing 22 and the cylinder block 21 of the housing, on the front side of the cylinder block 21.

A lag plate 31 is arranged in the crank chamber 30 and supported by the drive shaft 25 for rotation therewith. A pair of support arms 32 extend from the lag plate 31 toward the cylinder block 21, and have guide holes 33 extending in the direction intersecting the axis of the drive shaft 25.

A swash plate 35 substantially iii the form of a circular disk is tiltably attached to the drive shaft 25 in the crank chamber 30. The swash plate 35 has a pair of connecting members having spherical heads 36 which are slidably and tiltably fitted in the guide holes 33 of the support arms 32, respectively. Accordingly, the swash plate 35 is hinged to the lag plate 31 so that the tilting angle of the swash plate 35 with respect to the axis of the drive shaft 25 can be changed.

A spring 38 is arranged about the drive shaft 25 between-the swash plate 35 and the lag plate 31. The swash plate 35 is urged by this spring 38 so that the tilting angle of the swash plate 35 is reduced. A stopper 39 is arranged on the drive shaft 25 so that the swash plate 35 abuts against the stopper 39 to define the minimum tilting angle of the swash plate 35 when the swash plate 35 is moved in the direction in which the tilting angle is reduced.

Each of the pistons 29 has a piston rod 40 having a bearing 41 in the U-shape in cross-section formed such that the bearing 41 has axially spaced first and second bearing portions 41*a* and 41*b* and an axially extending third portion 41*e* interconnecting the first and second bearing portions 41*a* and 41*b*, with the swash plate 35 is arranged between the first and second bearing portions 41*a* and 41*b*. Here, the first bearing portion 41*a* is arranged on the side near the cylinder bore 28, and the second bearing portion 41*b* is arranged on the side remote from the cylinder bore 28. The first and second bearing portions 41*a* and 41*b* have mutually facing surfaces with semi-spherical grooves 41*c* and 41*d* formed therein.

Semi-spherical shoes 45 are arranged between the swash plate 35 and each of the semi-spherical grooves 41*c* and 41*d* of the first and second bearing portions 41*a* and 41*b* for converting the rotational movement of the swash plate 35 into the reciprocal movement of the pistons 29. The semi-spherical shoe 45 has a semi-spherical surface slidably engaging in the semi-spherical groove 41*c* and a flat surface slidable against a flat surface of the peripheral region 37 of the swash plate 35. Therefore, the swash plate 35 is operably connected at the peripheral region 37 thereof to the pistons 29 via respective pair of semi-spherical shoes 45. Two opposing semi-spherical shoes 45 together form a substantially complete sphere.

An oil communication hole 50 is arranged in and extends through the second bearing portion 41*b* for fluid communication between the semi-spherical groove 45 of the second bearing portion 41*b* and the crank chamber 30, so that misty lubricating oil prevailing in the crank chamber 30 can be introduced into the semi-spherical groove 45 of the second bearing portion 41*b* through the oil communication hole 50.

In addition, axially extending recesses 51 are formed on the outer surface of the pistons 29, so that blow-by gas can smoothly flow from the cylinder bore 29 to the crank chamber 30 through a clearance between the pistons 29 and the cylinder bore 29.

The rear housing 23 is divided into an annular peripheral portion forming a suction chamber 55 to be coupled to a suction pipe in a refrigerating circuit (not shown) and a central portion forming a discharge chamber 56 to be coupled to a discharge pipe in the refrigerating circuit. The suction chamber 55 is operatively connected to the cylinder bores 28 via a suction valve mechanism 57, and the discharge chamber 56 is operatively connected to the cylinder bores 28 via a discharge valve mechanism 58. The refrigerating circuit contains 1,1,1,2-tetrafluoroethane (HFC-134a) as cooling gas.

The crank chamber 39 is not directly connected to the suction chamber 55 and the discharge chamber 56, but it is connected to the suction chamber 55 via a fixed restricted passage (not shown) and to the discharge chamber 56 via a control valve (not shown) so that the pressure in the crank chamber 39 is controlled under the action of the fixed restricted passage and the control valve depending on the refrigerating load.

The operation of the single headed swash plate type compressor having the above described arrangement is now described.

The compressor is operated by a drive source such as an engine in an automobile. The drive shaft 25 with tile lag plate 31 is driven for rotation by the drive source. The swash plate 35 is thus rotated by the lag plate 31 via the support arms 32 having the guide holes 33 and the connecting members having spherical heads 36, and the pistons 29 are reciprocatingly moved at a stroke corresponding to the tilting angle of the swash plate 35. Cooling gas is sucked from the suction chamber 55 into the compression chamber formed in each cylinder bore 28, compressed in the compression chamber, and discharged from the compression chamber to the discharge chamber 56. Cooling gas is then supplied from the discharge chamber 56 to the refrigerating circuit to cool the compartment in the automobile, and returns to the suction chamber 55.

The tilting angle of the swash plate 35 is changed depending on the difference of the pressure in the crank chamber 30 and the pressure in the compression chamber in the cylinder bore 28 acting on the piston 29, to control the capacity of the compressor.

During the compressing operation, cooling gas containing misty lubricating oil is blown-by through a clearance between the cylinder bore 28 and the piston 29 into the crank chamber 30, and reserved in the crank chamber 30. In addition, liquid lubricating oil separated from cooling gas and collected in the discharge chamber 58 is introduced into the crank chamber 30 through a small conduit (not shown) and reserved in the lower part of the crank chamber 30.

In this manner, part of the lubricating oil reserved in the crank chamber 30 is conveyed up by the rotating lag plate 31 and the rotating swash plate 35, and lubricating oil is supplied to the sliding surfaces.

When the compressor is started in a poorly lubricated condition, lubricating oil contained in the crank chamber is extended all around the entire periphery 37 of the swash plate 35 during one revolution of the swash plate 35, and that lubricating oil can soak into the sliding surfaces 46 between the flat surfaces of the semi-spherical shoes 45 and the flat surfaces of the periphery 37 of the swash plate 35.

Also, blow-by gas leaks through a clearance between the cylinder bores 28 and the pistons 29 into the crank chamber 30 and prevails in the crank chamber 30. In particular, blow-by gas can be directly supplied to the sliding surfaces between the semi-spherical shoes 45 and the semi-spherical grooves 41*c* of the first bearing portion 41*a* on the side near the cylinder bore 28, and therefore, misty lubricating oil contained in blow-by gas can be easily supplied to the sliding surfaces on the side of the cylinder bore 28.

However, blow-by gas will flow, beyond the swash plate 35, to the sliding surfaces between the semi-spherical shoes 45 and the semi-spherical grooves 41*d* of the second bearing portion 41*b* on the side remote from the cylinder bore 28. Misty lubricating oil flowing in the crank chamber 30 can be supplied to the sliding surfaces between the semi-spherical shoes 45 and the semi-spherical grooves 41*d* on the side remote from the cylinder bore 28, through the oil communication hole 50 provided in the second bearing portion 41*b*.

Therefore, there are following advantages in the above described arrangement.

(a) When the compressor is started, misty lubricating oil flowing in the crank chamber 30 can be supplied to the sliding surfaces between the semi-spherical shoes 45 and the semi-spherical grooves 41*d* on the side remote from the cylinder bore 28, through the oil communication hole 50 provided in the second bearing portion 41*b* of the bearing 41 of the piston rod 40. Therefore, it is possible to efficiently lubricate the portion of the compressor to which it was difficult to sufficiently supply lubricating oil.

(b) Since the shoes 45 have a semi-spherical shape, the semi-spherical shoes 45 can slide in a three dimensional manner, accompanying their rotation in the semi-spherical grooves 41*c* and 41*d*, so the stable sliding contacts can be ensured although the tilting angle of the swash plate 35 changes and reliability of the compressor is improved.

(c) Cooling gas is a Freon substitute without chlorine, so there is no problem of the ozone layer destruction even if cooling gas is released to the atmosphere in the case of a repair or the like.

Figure 2:
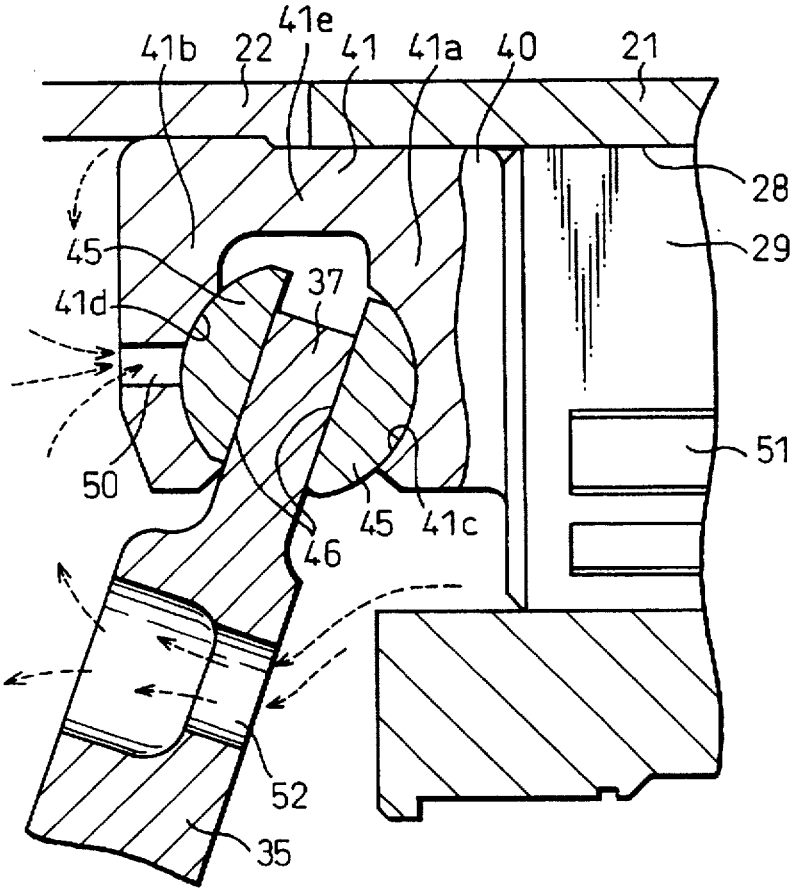
FIG. 2 is a cross-sectional view of a part of the compressor according to the second embodiment of the present invention.

The second embodiment of the present invention is described with reference to FIG. 2. FIG. 2 shows only a part of the compressor including the swash plate 35, the semi-spherical shoes 45 and the piston rod 40 having the bearing 41, but the other part of the compressor is similar to that of FIG. 1. In this embodiment, a through hole 52 is provided near the cylinder bore 28, which extends through the swash plate 35 for fluid communication between a portion of the crank chamber 30 on the side near the cylinder bore 28 and another portion of the crank chamber 30 on the side remote from the cylinder bore 29. Therefore, blow-by gas flowing through the clearance between the piston 29 and the cylinder bore 28 can rapidly flow from a portion of the crank chamber 30 on the one side of the swash plate 35, through the through hole 52, to another portion of the crank chamber 30 on the other side of the swash plate 35, as shown by the broken arrow in FIG. 2. Therefore, lubricating oil can rapidly flow in said another portion of the crank chamber 30 through the through hole 52 and can be efficiently supplied to the sliding surfaces between the semi-spherical shoes 45 and the semi-spherical grooves 41*d* of the second bearing portion 41*b* on the side remote from the cylinder bore 28, through the oil communication hole 50.

Figure 3:
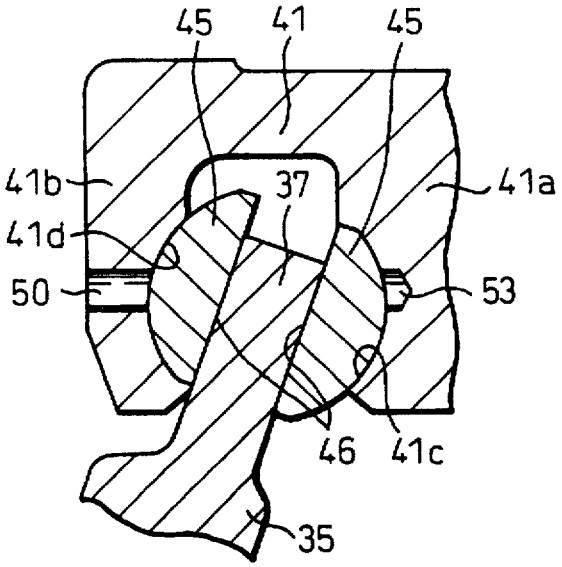
FIG. 3 is a cross-sectional view of a part of the compressor according to the third embodiment of the present invention.

The third embodiment of the present invention is described with reference to FIG. 3. FIG. 3 shows only a part of the compressor including the swash plate 35, the semi-spherical shoes 45 and the piston rod 40 having the bearing 41, but the other part of the compressor is similar to that of FIGS. 1 and 2. In this embodiment, a recess 53 is arranged in the semi-spherical groove 41*c* of the first bearing portion 41*a* at a position on an axis of the oil communication hole 50. The recess 53 can be machined by a leading end of a drill which drills the oil communication hole 50 in the second bearing portion 41b on the side remote from the cylinder bore 28. Therefore, the recess 53 functions as an oil reservoir hole, even if the sliding surfaces between the semi-spherical shoes 45 and the semi-spherical grooves 41*c* of the first bearing portion 41*b* on the side of the cylinder bore 28 becomes poorly lubricated while the compressor is stopped. These sliding surfaces can be lubricated by the lubricating oil reserved in the recess 53.

Figure 4:
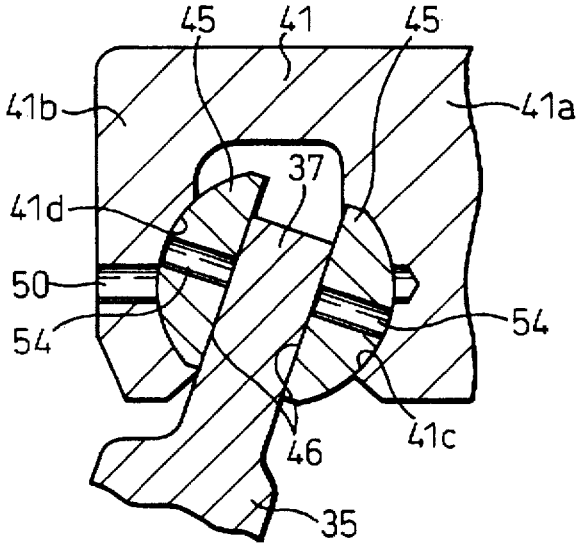
FIG. 4 is a cross-sectional view of a part of the compressor according to the fourth embodiment of the present invention.

The fourth embodiment of the present invention is described with reference to FIG. 4. FIG. 4 shows only a part of the compressor including the swash plate 35, the semi-spherical shoes 45 and the piston rod 40 having the bearing portion 41, but the other part of the compressor is similar to that of FIGS. 1 to 3. In this embodiment, a guide hole 54 extends through each of the semi-spherical shoes 45 between the flat surface thereof and the top of the spherical surface thereof. Therefore, lubricating oil can be supplied to the sliding surfaces between the semi-spherical shoes 45 and the semi-spherical grooves 41*d* of the second bearing portion 41*b* on the side remote from the cylinder bore 28.

(a) Misty lubricating oil in the crank chamber 30 is introduced through the oil communication hole 50 to those sliding surfaces.

(b) Lubricating oil reserved in the bottom of the crank chamber 30 is conveyed up by the peripheral region 37 of the rotating swash plate 35 and supplied to those sliding surfaces through the guide hole 54.

Figure 5:
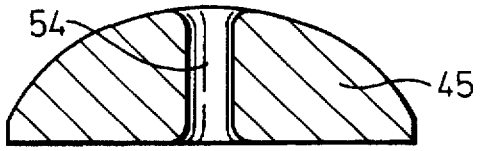
FIG. 5 is a cross-sectional view of the modified semi-spherical shoe of the compressor.

FIG. 5 shows a modification of the semi-spherrical shoe 45 of FIG. 4. In this example, both ends of the guide hole 54 are enlarged, compared with the remaining portion of the guide hole 54, to facilitate flow-in and flow-out of the lubrication oil.

Figure 6:
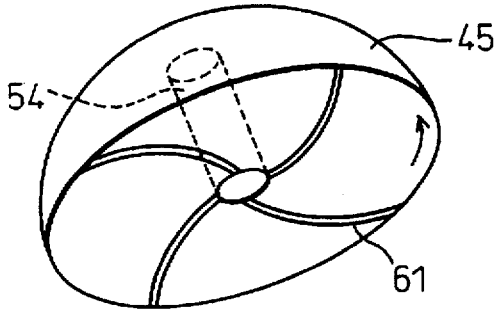
FIG. 6 is a perspective view of the modified semi-spherical shoe of the compressor.

FIG. 6 shows a further modification of the semi-spherical shoe 45 of FIG. 4. In this example, the semi-spherical shoe 45 has, in its flat surface, curved grooves 61. The curved grooves 61 are generally radially extended and are curved in the direction of the rotation of the semi-spherical shoe 45, shown by the arrow in FIG. 6. The curved grooves 61 function to collect the lubricating oil brought by the peripheral region 37 of the swash plate 35 in the guide hole 54.

Figure 7:
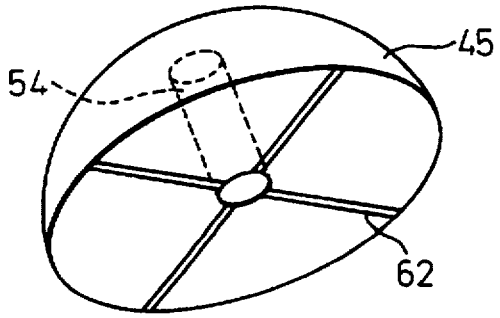
FIG. 7 is a perspective view of the modified semi-spherical shoe of the compressor.

FIG. 7 shows a further modification of the semi-spherical shoe 45 of FIG. 4. In this example, the semi-spherical shoe 45 has at its flat surface straight grooves 62. The straight grooves 62 are radially arranged. The straight grooves 62 functions to collect the lubricating oil brought by the peripheral region 37 of the swash plate 35 in the guide hole 54.

It will be understood that the present invention can be further modified within the scope and spirit of the present invention. For example, the shoes can have a rather flat shape. The shoes can have a semi-spherical shape corresponding to one half of a complete spherical shape, or the shoes can have a rounded shape corresponding to one half of an oblong shape. It is possible to use other Freon substitutions, without chlorine, such as HFC-134a.

We claim:

1. A single headed swash plate type compressor comprising:

a housing having a crank chamber and parallel cylinder bores formed therein;

pistons reciprocatingly arranged in the cylinder bores for compressing cooling gas in the cylinder bores, each of the pistons having at one end thereof axially spaced first and second bearing portions and an axially extending third portion interconnecting the first and second bearing portions, the first bearing portion being arranged on the side near the cylinder bore, the second bearing portion being arranged on the side remote from the cylinder bore, said first and second bearing portions having mutually facing surfaces with grooves formed therein;

a drive shaft rotatably arranged in the housing;

a swash plate attached to the drive shaft in the crank chamber;

a shoe slidably arranged between the swash plate and each of the first and second bearing portions in the groove thereof for converting the rotational movement of the swash plate into the reciprocal movement of the pistons; and an oil communication hole extending through the second bearing portion for fluid communication between the groove of the second bearing portion and the crank chamber.

2. A compressor according to claim 1, further comprising a through hole extending through the swash plate for fluid communication between a portion of the crank chamber on one side of the swash plate and another portion of the crank chamber on the other side of the swash plate.

3. A compressor according to claim 1, further comprising a recess arranged in the groove of the first bearing portion at a position on an axis of said oil communication hole.

4. A compressor according to claim 1, wherein said shoe is formed in a semi-spherical shape with a semi-spherical surface and a flat surface, and said groove is formed in a semi-spherical shape, the semi-spherical surface of the semi-spherical shoe slidably engaging in the semi-spherical groove and the flat surface of the semi-spherical shoe being slidable against the swash plate on the peripheral region thereof.

5. A compressor according to claim 4, further comprising a guide hole extending through the shoe between the flat surface thereof and the spherical surface thereof.

6. A compressor according to claim 5, wherein said guide hole has first and second opposite ends, at least one of said first and second ends being enlarged, compared with the remaining portion of said guide hole.

7. A compressor according to claim 5, wherein said shoe has in the flat surface thereof radially extending grooves to merge said guide hole.

8. A compressor according to claim 1, wherein said cooling gas to be compressed comprises 1,1,1,2-tetrafluoroethane.

9. A compressor according to claim 1, further comprising a recess formed on the outer surface of the piston, so that blow-by gas can smoothly flow from the cylinder bore to the crank chamber.

10. A compressor according to claim 1, further comprising:

a lag plate attached to the drive shaft in the crank chamber for rotation therewith, the lag plate having a pair of support arms extending toward the swash plate, the support arms having guide holes; and the swash plate having a pair of connecting members extending toward the lag plate, the connecting members being slidably and tiltably fitted in the guide holes of the support arms, so that the swash plate is hinged to the lag plate by the support arms and the connecting members to allow the tilting angle of the swash plate to be changed to control the capacity of said compressor.

* * * * *